United States Patent [19]

Arnau et al.

[11] 4,147,649

[45] Apr. 3, 1979

[54] LIQUID DETERGENT COMPOSITION

[75] Inventors: Jose L. Arnau, Wemmel; Christian R. Barrat, Meise; Jean Wevers, Brussels, all of Belgium

[73] Assignee: The Procter & Gamble Company, Cincinnati, Ohio

[21] Appl. No.: 753,349

[22] Filed: Dec. 22, 1976

[30] Foreign Application Priority Data

Jan. 2, 1976 [GB] United Kingdom ..... 00057/76

[51] Int. Cl.[2] ..... C11D 1/83

[52] U.S. Cl. ..... 252/89 R; 252/DIG. 1; 252/DIG. 14; 252/539; 252/559

[58] Field of Search ..... 252/DIG. 1, 559, 89, 252/539

[56] References Cited

U.S. PATENT DOCUMENTS

| | | | |
|---|---|---|---|
| 2,954,348 | 9/1960 | Schwoeppe | 252/559 |
| 3,156,655 | 11/1964 | Bright | 252/DIG. 1 |
| 3,523,902 | 8/1970 | Schmolka | 252/559 |
| 3,682,849 | 8/1972 | Smith | 260/615 B |
| 3,707,506 | 12/1972 | Lozo | 252/139 |
| 3,709,838 | 1/1973 | Mausner et al. | 252/545 |
| 3,869,399 | 3/1975 | Collins | 252/559 |
| 3,931,033 | 1/1976 | Lohr | 252/DIG. 1 |
| 3,933,672 | 1/1976 | Bartolotag et al. | 252/89 R |
| 3,963,649 | 6/1976 | Spadini et al. | 252/546 |
| 3,983,073 | 9/1976 | Collins | 252/540 |
| 3,994,818 | 11/1976 | Vanderloo et al. | 252/DIG. 1 |
| 3,998,750 | 12/1976 | Payne | 252/559 |

FOREIGN PATENT DOCUMENTS 759877 10/1956 United Kingdom.

*Primary Examiner*—George F. Lesmes
*Assistant Examiner*—E. Rollins Buffalow

[57] ABSTRACT

Concentrated, stable, liquid, heavy duty detergent composition containing an ethoxylate of a primary alcohol of from 14 to 22 carbon atoms and of at least 65% branched structure; an ethoxylate of a straight or branched, primary or secondary alcohol of 9 to 15 carbon atoms; a surfactant of the sulfonate type; and a liquid carrier. These compositions are especially adapted for stain and soil removal from fabrics, either by topical application to such fabrics prior to washing, or for a conventional fabric laundering.

1 Claim, No Drawings

LIQUID DETERGENT COMPOSITION

BACKGROUND OF THE INVENTION

1. Field of the Invention

The present invention relates to concentrated, stable, homogeneous, liquid, heavy duty detergent compositions. Such compositions contain two types of nonionic surfactants, an anionic surfactant component, and a liquid carrier. The compositions may also contain minor amounts of enzymes, brighteners, suds regulating agents, and other usual liquid detergent additives.

2. Description of the Prior Art

To be satisfactory for washing heavily soiled fabrics, in particular cotton fabrics, liquid detergent compositions must contain an adequate concentration of surfactants, remain stable and homogeneous when subjected to various storage conditions and be designed for use in both horizontal (tumble drum type) and upright (vertical agitator type) washing machines.

Liquid, heavy duty detergent compositions containing a synthetic organic detergent compound, which is generally anionic, nonionic or mixed anionicnonionic in nature; an inorganic builder salt; and a solvent, are disclosed, for example, in U.S. Pat. Nos. 2,908,651; 2,920,045; 3,272,753; 3,393,154; and Belgian Pat. Nos. 613,165; 665,532; 794,713 and 817,267. These compositions frequently contain a hydrotrope or solubilizing agent to permit the addition of sufficient quantities of surfactants and usual builder salts to provide a reasonable volume usage/performance ratio. Others are substantially anhydrous liquid compositions containing an alkanolamine component (U.S. Pat. No. 3,528,925). Still others contain a soap component (U.S. Pat. Nos. 2,875,153 and 2,543,744).

Liquid, heavy duty detergent compositions containing a mixture of at least two nonionic surfactants and optionally anionic surfactants are disclosed in U.S. Pat. Nos. 3,709,838; 3,697,451; 3,554,916; 3,239,468; 2,947,702; 2,551,634; British Pat. Nos. 900,000; 842,813; 759,877; Canadian Pat. No. 615,583; German applications Nos. 2,362,114; 2,361,448; 2,330,840; 2,327,861; 1,937,682 and 1,617,119.

As can be seen from the foregoing, a substantial effort has been expended in developing built and builder-free detergent compositions in liquid form. Yet, there are several problems associated with the art-disclosed compositions which render them less than optimal for wide scale use, undersirable from an ecological standpoint in improperly treated sewage, objectionable from a performance point of view in cleaning both natural and synthetic fibers and subject to instability under severe storage conditions.

It has now been found that superior overall detergency is obtained if a mixture of two types of certain ethylene-oxide-based nonionic surfactants, whereby the hydrophobic moiety of at least one of said nonionics is derived from a primary aliphatic alcohol of at least 65% branched structure, and an anionic of the sulfonate type is used at high concentrations in liquid detergent compositions.

It has also been found that liquid, concentrated compositions containing these nonionic surfactants and an anionic surfactant exhibit superior physical properties, remain homogeneous and stable under severe storage conditions and stand the addition of adjuvants.

It is, therefore, an object of this invention to provide concentrated, liquid, heavy duty detergent compositions which exhibit excellent grease stain removal by topical application and through-the-wash fabric cleaning.

It is another object herein to provide concentrated, liquid, heavy duty detergent compositions which remain stable and homogeneous under severe storage conditions.

It is still another object to provide liquid, stable, concentrated, homogeneous, heavy duty detergent compositions containing useful adjuvants.

It is still another object herein to provide concentrated, liquid, stable, homogeneous, heavy duty detergent compositions which exhibit low sudsing characteristics at high concentrations during use in automatic washing machines.

These and other objects are obtained herein, as will be seen from the following disclosure.

SUMMARY OF THE INVENTION

The present invention encompasses a concentrated, stable, essentially homogeneous, liquid, heavy duty detergent composition containing:

(1) from about 25% to about 80% by weight of a surfactant mixture, consisting essentially of:

(A) a nonionic surfactant of the general formula $$R_1O-(C_2H_4O)_x-H \quad \text{(I)}$$

wherein $R_1$ represents a hydrocarbyl group derived from a primary aliphatic alcohol of at least 65% branched-chain structure, having from 14 to about 22 carbon atoms; and x is a number from about 9 to about 14;

(B) a nonionic surfactant of the general formula $$R_2O-(C_2H_4O)_y-H \quad \text{(II)}$$

wherein $R_2$ is a hydrocarbyl group derived from a primary or secondary, straight or branched aliphatic alcohol, having from about 9 to about 15 carbon atoms; and y is a number from about 3 to about 8;

wherein the weight ratio of (A) to (B) is from about 10:1 to about 1:1;

(C) an anionic surfactant of the general formula $$R_3SO_3M \quad \text{(III)}$$

wherein $R_3$ represents a hydrocarbyl group selected from the group consisting of straight or branched alkyl radicals having from 12 to about 24 carbon atoms; and alkylphenyl radicals having from 9 to about 15 carbon atoms in the alkyl group; and M is a salt-forming cation selected from the group consisting of Na, K, $NH_4$, and mono-, di-, and trialkanolamines having 2 to 3 carbon atoms in the alkanol groups;

wherein the weight ratio of (A) +(B) to (C) is from about 7:1 to about 1:1;

(2) from about 1 to about 75% by weight of a liquid, organic carrier selected from the group consisting of a lower aliphatic alcohol having from 2 to about 6 carbon atoms and 1 to 3 hydroxyl groups; ethers of diethylene glycol and lower aliphatic mono-alcohols having from 1 to 4 carbon atoms; water-soluble salts of alkylbenzene sulfonic acids having up to 3 carbon atoms in the alkyl groups; and mixtures thereof;

(3) balance: water;

the pH of the composition being between about 6.5 and about 9.5.

In a preferred composition aspect, the liquid composition comprises the surfactant mixture present in an amount of from about 35% to about 65% by weight, wherein the weight ratio of nonionic surfactant (A) to nonionic surfactant (B) is from about 5:1 to about 2:1, and the weight ratio of the nonionic surfactants (A) + (B) to the anionic surfactant (C) is from about 4:1 to about 2:1. In another preferred embodiment the hydrocarbyl group $R_1$ of nonionic surfactant (A) is derived from a primary alkanol of at least 70% branched-chain structure, and the hydrocarbyl group $R_2$ of nonionic surfactant (B) is derived from a primary alkanol of at least 25% preferably at least 40% branched-chain structure.

The preferred nonionic surfactant (A) has a hydrophobic moiety $R_1$ containing from about 16 to about 19 carbon atoms and a hydrophilic moiety $—(C_2H_4O)_x—H$ wherein x is a number from about 9 to about 13; the preferred nonionic surfactant (B) has a hyrophobic moiety $R_2$ containing from about 12 to about 15 carbon atoms and a hydrophilic moiety $—(C_2H_4O)_y—H$ wherein y is a number from about 3 to about 6.

The preferred anionic surfactant (C) is a triethanol amine salt of alkylbenzene sulfonic acid, having from about 9 to about 15 carbon atoms in the alkyl groups.

The liquid compositions of this invention are sufficiently stable after having been subjected to various temperatures and conditions of storage between time of production and use, sufficiently fluid to permit ready measurement, and substantially homogeneous in composition to ensure that the washing solution will contain the proper ratio of ingredients, permitting easy dispersion in water and optimum cleanig efficiency.

The attractivity, efficacity and economy of the compositions of this invention can also be improved, adapted or tailored to suit specific needs by admixing additional components, in particular, foam-regulating agents, e.g.; self-dispersible silicone compounds; further the usual additives such as perfumes, dyes, brighteners, anti-corrosion agents, bactericides, enzymes, soil-suspending agents as more specifically indicated hereinafter.

DETAILED DESCRIPTION OF THE INVENTION

The properties of the compositions of the present invention are the result of a combination of different components and a number of factors. Therefore, both components and factors have to be properly selected and correlated. The individual components of the instant detergent compositions and the factors of consideration are described in detail below.

The Nonionic Surfactants (A) The instant compositions contain as an essential component a nonionic surfactant of the general formula $$R_1O—(C_2H_4O)_x—H \qquad (I)$$

wherein $R_1$ represents a hydrocarbyl group derived from a primary alcohol of at least 65% branched-chain structure, having from 14 to 22 carbon atoms; and x is a number from about 9 to about 14.

Ethoxylated nonionic surfactants can be prepared by a variety of methods well known in the art. In general terms, such nonionic surfactants are conventionally produced by condensation of ethylene oxide, forming the hydrophilic moiety, with an alcohol, forming the hydrophobic moiety, in the presence of acidic or basic catalysts. Such procedures result in the production of a product mixture comprising a number of nonionics of varying ethoxylate content. Therefore, the conventional designation of the number of ethylene oxide units present per molecule of an alcohol ethoxylate designated, for example, in formula (I) by x is an indication of the average number of ethylene oxide units per molecule of alcohol according to a statistic distribution where the peak is situated around the x number.

The nonionic surfactants or alcohol ethoxylates of the general formula (I) contain in average from about 9 to about 14, preferably from about 9 to about 13 ethylene oxide units per molecule of alcohol. Most preferred are nonionics which are rendered substantially free, i.e. containing less than about 15% by weight, of nonethoxylated alcohols and ethoxylated alcohols containing x−5 and less, and x+5 and more ethylene oxide units.

The hydrocarbon or hydrophobic moiety of the nonionic surfactants of the general formula (I) is derived from primary aliphatic alcohols, having from about 14 to about 22, preferably from about 16 to 19 carbon atoms, and of at least 65%, preferably of at least 70% branched-chain structure.

Primary alcohols can be derived from animal and vegetable oils and fats by, for example, hydrogenolysis of said oils, fats or corresponding fatty acids. They are substantially straight-chain or linear alcohols.

Primary alcohols can also be obtained from synthetic sources by different processes. The usual raw materials are polymers of lower alkylenes or olefins. According to the type of polymers, olefins, processes and process conditions, alcohols with a different degree of linearity or branching are obtained. (see, for example, Nonionic Surfactants, by M. J. Schick; 1967; M. Dekker, Inc., New York, pages 87–90). The major part of the commercially-available primary synthetic alcohols are prepared by either the "OXO" or "Ziegler" process.

The nonionic surfactants of general formula (I) primarily determine the improved detergency, stability and homogeneity characteristics of the composition of the present invention. Therefore, they are the key in the formulation of highly concentrated compositions of the present invention.

The primary aliphatic alcohols of at least 65% branched-chain structure, used for producing the nonionic surfactant of general formula (I) key in the compositions of the present invention can be represented by the general formula:

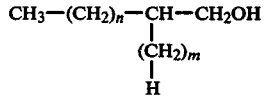

$$CH_3—(CH_2)_n—\underset{\underset{H}{|}}{\underset{(CH_2)_m}{|}}CH—CH_2OH \qquad (IV)$$

wherein m is a whole number from 0 to 9 inclusive and n is a whole number from 11 to 19 inclusive, selected so that m + n is a whole number from 11 to 19 inclusive, whereby at least 65% by weight of the primary alcohol of formula IV, having from about 14 to about 22, preferably from about 16 to about 19 carbon atoms, are of a branched-chain structure, i.e., wherein m is a whole number from 1 to 9 inclusive.

A highly preferred nonionic of the general formula (I) contains the following hydrocarbyl groups:

| HOMOLOGUE DISTRIBUTION | | | | | | | | Total % | |
|---|---|---|---|---|---|---|---|---|---|
| $C_{14}$ | $C_{15}$ | $C_{16}$ | $C_{17}$ | $C_{18}$ | $C_{19}$ | $C_{20}$ | $C_{21}$ | linear | branched |
| — | 1 | 9 | 10 | 7 | 1 | — | — | 28 | |
| 2 | 4 | 16 | 20 | 23 | 7 | — | — | | 72 |

Suitable examples of nonionic surfactants of the general formula (I) can, for example, be prepared from primary aliphatic alcohols of at least 65% branched-chain structure, obtained by hydroformilation of random olefins, which in turn have been obtained by dehydrogenation of n-paraffins, containing from about 13 to about 21 carbon atoms, condensed with from about 8 (in average) to about 14 (average) moles of ethylene oxide per mole of the primary aliphatic alcohol. Nonlimiting, specific examples of the nonionic surfactants having the requisite carbon content in the branched hydrocarbyl portion and the requisite ethylene oxide units are:

$C_{11}H_{23}CH(C_5H_{11})CH_2—O—(C_2H_{11}O)_9—H$
$C_{12}H_{25}CH(CH_3)CH_2—O—(C_2H_4O)_9—H$;
$C_{12}H_{25}CH(CH_3)CH_2—O—(C_2H_4O)_1—H$;
$C_{12}H_{25}CH(CH_3)CH_2—O—(C_2H_4O)_{13}—H$;
$C_{13}H_{27}CH(CH_3)CH_2—O—(C_2H_4O)_{10}—H$;
$C_{13}H_{27}CH(CH_3)CH_2—O—(C_2H_4O)_{12}—H$;
$C_{15}H_{31}CH(CH_3)CH_2—O—(C_2H_4O)_9—H$;
$C_{15}H_{31}CH(CH_3)CH_2—O—(C_2H_4O)_{11}—H$;
$C_{16}H_{33}CH(CH_3)CH_2—O—(C_2H_4O)_9—H$;
$C_{16}H_{33}CH(CH_3)CH_2—O—(C_2H_4O)_{11}—H$;
$C_{17}H_{35}CH(CH_3)CH_2—O—(C_2H_4O)_{12}—H$;
$C_{12}H_{25}CH(C_2H_5)CH_2—O—(C_2H_4O)_9—H$;
$C_{12}H_{25}CH(C_2H_5)CH_2—O—(C_2H_4O)_{11}—H$;
$C_{14}H_{29}CH(C_2H_5)CH_2—O—(C_2H_4O)_{11}—H$;
$C_{15}H_{31}CH—(C_2H_5)CH_2—O—(C_2H_4O)_{12}—H$;
$C_{12}H_{25}CH(C_3H_7)CH_2—O—(C_2H_4O)_{12}—H$;
$C_{13}H_{27}CH(C_4H_9)CH_2—O—(C_2H_4O)_{11}—H$;
$C_9H_{19}CH(C_6H_{13})CH_2—O—(C_2H_4O)_9—H$;
$C_9H_{19}CH(C_7H_{15})CH_2—O—(C_2H_4O)_{12}—H$;
$C_{11}H_{23}CH(C_4H_9)\quad CH_2—O—(C_2H_{11})_{11}—H$;
$C_{11}H_{23}CH(C_5H_{11})CH_2—O—(C_2H_4O)_{12}—H$;
$C_{10}H_{21}CH(C_6H_{13})CH_2—O—(C_2H_4O)_{11}—H$; and mixtures thereof.

(B) The instant compositions contain as another essential component a nonionic surfactant of the general formula $$R_2O—(C_2H_4O)_y—H \qquad (II)$$

wherein $R_2$ represents a hydrocarbyl group derived from a primary or secondary, linear or branched alcohol having from about 9 to about 15, preferably from about 12 to about 15 carbon atoms; and y is a number from about 3 to about 8, preferably from about 3 to about 6.

The nonionic surfactants of general formula (II) can be prepared by a variety of methods well known in the art. They can be prepared from primary linear alcohols of natural sources and from primary and secondary alcohols of synthetic sources. Preferred are nonionics derived from primary alcohols of at least 25%, preferably at least 40% branched-chain structure, having from about 9 to about 15, most preferably from about 12 to about 15 carbon atoms. The hydrophilic portion of the nonionic surfactants contains from about 3 to about 8, preferably from about 3 to about 6 ethylene oxide units per molecule of alcohol. Most preferred are nonionics of formula (II) which are rendered substantially free, i.e., containing less than 15% by weight of non-ethoxylated alcohols and ethoxylated alcohols having y + 5 and more ethylene oxide units.

Non-limiting, specific examples of nonionic surfactants responding to the general formula (II), having the requisite carbon content in the hydrocarbyl portion of the molecule and the requisite number of ethylene oxide units are: $n—C_{10}H_{21}O—(C_2H_4O)_3—H$; $n—C_{12}H_{25}O—(C_2H_4O)_4—H$; $n—C_{14}H_{29}O—(C_2H_4O)_4—H$; $n—C_{15}H_{31}O—(C_2H_4O)_6—H$; $n—C_{10}H_{21}O—(C_2H_4O)_8—H$; $n—C_{15}H_{31}O—(C_2H_4O)_5—H$;
$C_7H_{15}CH(C_5H_{11})CH_2O—(C_2H_4O)_4—H$;
$C_9H_{19}CH(C_3H_7)CH_2O—(C_2H_4O)_3—H$;
$C_{12}H_{25}CH(CH_3)CH_2O—(C_2H_4O)_4—H$;
$(C_6H_{13})_2CHCH_2O—(C_2H_4O)_4—H$;
$C_8H_{17}CH(C_6H_{13})O—(C_2H_4O)_6—H$;
$C_{12}H_{25}CH(CH_3)O—(C_2H_4O)_5—H$;
$(CH_3(_3C(CH_2)_8CH_2O—(C_2H_4O)_3—H$; and mixtures thereof.

The nonionic surfactants (I) and (II) disclosed hereinbefore are present in the instant compositions in a weight ratio in the range from about 10:1 to about 1:1, preferably from 5:1 to 2:1. Varying the weight ratios of the nonionic surfactants (I) and (II) herein to ratios substantially outside the specified range can adversely affect the stability, homogeneity and/or performance of the compositions of this invention. If the nonionic surfactants (I) and (II) disclosed hereinbefore have the same or approximately the same number of carbon atoms in the hydrophobic moiety then the average number of ethylene oxide units of the nonionics (I) and (II) should be different by at least 2, preferably at least 3 units in order to conserve the outstanding overall soil removal properties.

The Anionic Surfactant (C) The instant compositions of the present invention contain as a third essential component an anionic surfactant of the general formula $$R_3SO_3M \qquad (III)$$

wherein $R_3$ represents a hydrocarbyl group selected from the group consisting of straight or branched alkyl radicals having from 12 to 24 carbon atoms; and alkylphenyl radicals having from 9 to 15 carbon atoms in the alkyl group; and M is a salt-forming cation selected from the group consisting of Na, K, $NH_4$, and mono-, di-, and trialkanol amines having 2 to 3 carbon atoms in the alkanol groups. The preferred anionic surfactant component of the instant detergent composition is a water-soluble salt of an alkylbenzene sulfonic acid, preferably an alkanolamine alkylbenzene sulfonate, having from about 12 to about 15 carbon atoms in the alkyl group. More specifically, the preferred anionic surfactant herein consists of a mono-, di-, or triethanolamine salt of a straight chain alkylbenzene sulfonic acid in which the alkyl group contains in average about 12 carbon atoms. The preferred alkanolamine alkylbenzene sulfonate salts are prepared by neutralizing the alkylbenzene sulfonic acid with an alkanolamine selected from the group consisting of mono-, di-, and triethanolamine. The triethanolamine salts are preferred herein. Specific examples of alkanolamine salts of alkylbenzene sulfonic acids useful in the instant invetion include triethanolamine decyl benzene sulfonate, triethanolamine dodecyl benzene sulfonate, diethanolamine undecyl benzene sulfonate, monoethanolamine tridecylbenzene sulfonate, triethanolamine tetradecyl benzene sulfonate, and mixtures thereof. Other anionic surfactants useful herein include the organic sulfuric acid reaction products having in their molecular structure an aliphatic hydrocarbon group containing from about 12 to about 24 carbon atoms, or mixtures thereof. Examples of this group of synthetic detersive anionic surfactants are the paraffin sulfonates, especially the secondary paraffin sulfonates having in average 13 to 16 carbon atoms; and olefin sulfonates. The anionic surfactants are used in the form of their sodium, potassium, ammonium, but preferably in the form of their mono-, di- and triethanolammonium salts, or mixtures thereof. The anionic surfactant (III) disclosed hereinbefore is present in the instant composition in specific proportions with respect to the nonionic surfactants in order to ensure effective cleaning power, stability and homogeneity. Weight ratios of nonionics (I) + (II) to anionic surfactant (III) in the range from about 7:1 to about 1:1, preferably from 4:1 to 2:1 are required. Ratios outside the range can adversely affect the cleaning performance, washing machine compatibility, stability and/or homogeneity.

Adjust Surfactants

The compositions herein can optionally employ various other adjunct surfactants which can be used to perform specific cleaning, grease-emulsifying, suds-modifying functions or as corrosion inhibitors. Such optional surfactants include semi-polar surface active agents, fatty acids and corresponding soaps, alkyl sulfates and ethoxylated alkyl sulfates, known in the art. Semi-polar surfactants useful herein include water-soluble amine oxides containing one alkyl moiety of from about 10 to 24 carbon atoms and two moieties selected from the group consisting of alkyl moieties and hydroxyalkyl moieties containing from 1 to about 3 carbon atoms. The fatty acids useful herein, particularly when added as corrosion inhibitors, are higher fatty acids containing from 12 to 24 carbon atoms of natural or synthetic origin. Preferred corrosion inhibitors are fatty acids derived from hydrogenated fish oils, containing 18 to 24 carbon atoms. The natural soaps useful herein are the sodium potassium, ammonium and ethanolamine salts of the higher fatty acids. Alkyl sulfates useful herein are the water-soluble salts, in particular the ethanolamine salts of sulfated higher alcohols especially those obtained by sulfating fatty alcohols containing from about 12 to 18 carbon atoms. Ethoxylated alkyl sulfates useful herein are the water-soluble salts, preferably the ethanolamine salts of sulfuric acid esters of the reaction product of one mole of a higher fatty alcohol, e.g., tallow or coconut alcohols, and 1 to about 15, preferably from about 3 to about 9 moles of ethylene oxide. The concentration of the adjunct surfactants in the instant compositions should preferably be below 10%, most preferably below 5% by weight, calculated on the amounts of essential nonionic and anionic surfactants. Most preferred adjunct surfactants are the fatty acids derived from hydrogenated fish oil present in amounts of from 1% to 5% by weight, calculated on the weight of the essential surfactants.

Liquid Carrier

Although compositions containing the above-described essential surfactants remain liquid and stable under most circumstances, the instant compositions contain, in addition, a liquid, organic carrier or solvent or aqueous mixtures thereof. Such liquid carriers or solvents can be employed to the extent of from about 1% to about 75%, preferably of from about 3% to about 15% by weight of the total composition. The liquid, organic carriers are selected from the group consisting of a lower aliphatic alcohol having from 2 to about 6 carbon atoms and 1 to 3 hydroxyl groups; ethers of diethylene glycol and lower aliphatic mono-alcohols having from 1 to 4 carbon atoms; water-soluble salt of alkylbenzene sulfonic acids having up to 3 carbon atoms in the alkyl groups; and mixtures thereof. Suitable examples of lower aliphatic alcohols useful in the instant compositions are ethanol, n-propanol, isopropanol and butanol; 1,2-propanediol, 1,3-propanediol, and n-hexanol. Useful examples of glycol ethers are monomethyl-, -ethyl-, -propyl-, and monobutyl ethers of diethylene glycol; and mixtures thereof Other organic solvents having a relatively high boiling point and low vapor pressure can also be used, provided they do not react with any of the other ingredients present. Hydrotropes that can be used in the instant compositions are the water-soluble alkylaryl sulfonates having up to 3 carbon atoms in an alkyl group such as sodium, potassium, ammonium, and ethanol amine salts of xylene-, toluene-, ethylbenzene- and isopropyl benzene sulfonic acids. In the preferred compositions, the liquid carrier is an aqueous mixture, wherein the amount of liquid, organic carrier, preferably ethanol, propanol, isopropanol, ethanolamine salt of cumene sulfonic acid, and mixtures thereof, is between 3% and 15% by weight of the total composition, and wherein most preferably the weight ratio of water to liquid, organic carrier is between from about 10:1 to about 1:1.

Concentration and Ratios

Heavy duty liquid detergent compositions, to be suited for the washing of heavily soiled cotton fabrics and other fabrics, require high concentrations of detergent compounds of powerful cleaning effect. They must exhibit a high degree of stability upon storage over a period of months under different temperature conditions. They must be free-flowing from the receptacle as manufactured and after aging. They must be homogeneous in composition at the time of use to ensure the addition of the proper amount and ratio of the components. The physical and cleaning properties of the instant compositions are the result of mutual effect of the different components in proper ratios. Therefore, it is the key to stability, pourability, homogeneity and cleaning effectiveness, that the essential surfactants be present in specific ratios and sufficient concentration. The instant compositions are specifically designed to provide optimum cleaning benefits when used either as pre-treatment agents, preferably applied in highly concentrated from directly onto the fabric stains prior to washing, or as detergents for conventional through-the-wash fabric laundering operations. Hence, highly concentrated, liquid, stable, homogeneous detergent compositions, which can be topically applied onto stains as such, and can be conveniently added to the washing liquors, provide a clear formulation advantage. The instant compositions remain liquid, stable, homogeneous with a surfactant content variable within the range of from about 25% to about 80% by weight, with the balance being primarily the liquid organic carrier and water, provided that at least 50% by weight of the mixture of nonionics of general formulae (I) and (II) consist of nonionics of general formula (I) while the weight ratio of the mixture of nonionics to the anionic of general formula (III) is between about 7:1 to about 1:1. The weight ratio of nonionic of general formula (I) to nonionic of general formula (II) should not exceed the 10:1 ratio, however, in order to ensure proper grease stain removal performance in both pre-treatment application and through-the-wash utilization of the instant compositions. The stability of the instant compositions versus similar compositions containing a higher amount of organic liquid carrier, e.g., ethanol, is apparent from the following tests and Table I. A series of compositions have been prepared and placed in Jena-glass test tubes (180 × 17 mm) in a thermostated bath kept at 25° C. Every 10 minutes the samples were shaken (to diminish the chance of supercooling) and the temperature decreased by 1° C. At each temperature, the samples were checked visually for turbidity and solidification, and the temperatures at which turbidity or solidification occurred were recorded.

TABLE I

| | Components in % by weight | | | | | | | | | Chill Point at |
|---|---|---|---|---|---|---|---|---|---|---|
| Test | A | B | C | D | E | F | G | H | J | °C. |
| 1 | 10 | 10 | — | 30 | — | 15 | 35 | — | 1.0 | 15 |
| 2 | 10 | — | 10 | — | 30 | 10 | 40 | — | 1.0 | −4 |
| 3 | 20 | 10 | — | 20 | — | 15 | 35 | — | 1.0 | 4 |
| 4 | 20 | — | 10 | — | 20 | 10 | 40 | — | 1.0 | <−7 |
| 5 | 20 | 15 | — | 15 | — | 15 | 35 | — | 1.0 | 5 |
| 6 | 20 | — | 15 | — | 15 | 10 | 40 | — | 1.0 | 3 |
| 7 | 20 | — | 10 | 20 | — | 15 | 35 | — | 1.0 | 0 |
| 8 | 20 | 10 | — | — | 20 | 10 | 40 | — | 1.0 | −5 |
| 9 | 20 | 10 | — | 20 | — | 15 | 34.5 | 0.5 | 1.0 | 5 |
| 10 | 20 | 10 | — | 20 | — | 15 | 34 | 1.0 | 1.0 | 9 |
| 11 | 20 | 10 | — | 20 | — | 15 | 33.5 | 1.5 | 1.0 | 15 |
| 12 | 20 | — | 10 | — | 20 | 10 | 39.5 | 0.5 | 1.0 | <−7 |
| 13 | 20 | — | 10 | — | 20 | 10 | 39 | 1.0 | 1.0 | <−7 |
| 14 | 20 | — | 10 | — | 20 | 10 | 38.5 | 1.5 | 1.0 | <−7 |

<−7 = chill point below −7° C.

A = triethanolamine salt of alkylbenzene containing in average 11.9 carbon atoms in alkyl group;

B = condensation product of one mole of a mainly straight-chain primary alcohol having in average 14.5 carbon atoms and about four moles of ethylene oxide;

C = condensation product of one mole of a primary alcohol of about 60% branched-chain structure having in average 12 to 15 carbon atoms and about four moles of ethylene oxide;

D = condensation product of one mole of a tallow alcohol and about 11 moles of ethylene oxide;

E = condensation product of one mole of a primary alcohol of about 70% branched-chain structure having in average 16 to 19 carbon atoms and about 11 moles of ethylene oxide;

F = ethanol;

G = water;

H = fatty acid derived from hydrogenated fish oil;

J = triethanolamine (free). From Table I it also follows that fatty acids having from 18 to 22 carbon atoms can easily be incorporated in the instant compositions without affecting the stability over a wide temperature range. In general, the surfactant content of liquid detergent compositions should not be excessive as it tends to gel the system. The surfactant content of the instant compositions can be varied beyond amounts which are harmful in similar compositions, as shown in Table II.

Two series (M and N) each of two liquid compositions were prepared consisting of (in % by weight)

| | $M_1$ | $M_2$ | $N_1$ | $N_2$ |
|---|---|---|---|---|
| Triethanolamine salt of alkylbenzene sulfonic acid containing in average 11.9 carbon atoms in the alkyl group | 20 | 20 | 20 | 20 |
| Condensation product of one mole of primary alcohol of about 60% branched-chain structure having from 12 to 15 carbon atoms and about 4 moles of ethylene oxide | 10 | 10 | 10 | 10 |
| Condensation product of one mole of tallow alcohol and about 11 moles of ethylene oxide | 20 | 20 | — | — |
| Condensation product of one mole of a primary alcohol of about 70% branched-chain structure having from 16 to 19 carbon atoms and 11 moles of ethylene oxide | — | — | 20 | 20 |
| Fatty acid derived from hydrogenated fish oil | — | 0.5 | — | 0.5 |
| Ethanol | 15 | 15 | 10 | 10 |
| Triethanolamine (free) | 1 | 1 | 1 | 1 |
| Water | | balance | | |

15 ml of composition M were poured onto a petri-dish (diameter 9 cm), exposed to air at ambient temperature (19–21° C.), and checked for gelling at regular intervals and graded by a 0 to 5 scale (0 = completely solid; 5 = product as poured onto the dish). The same thing was repeated with 15 ml of composition N. The results are:

TABLE II

| | Compositions | | | |
|---|---|---|---|---|
| Time in hours | $M_1$ | $M_2$ | $N_1$ | $N_2$ |
| 0 | 5 | 5 | 5 | 5 |
| 1 | 2 | 4 | 5 | 5 |
| 3 | 1 | 2 | 3 | 5 |
| 5 | 0 | 2 | 3 | 5 |

A heavy duty liquid detergent must be homogeneous in composition at the time of addition to the washing machine in order to ensure that the washing solution will contain the proper ratio of components. The superior homogeneity of the instant compositions compared to similar ones is evident from the following Table III. Three series of liquid compositions (P, R, S) were prepared, consisting of (all percentages by weight): Series P: 20% of component A, 10% of component C, 20% of component E, 1% of component H of Table I, 10% ethanol, balance: water; Series R: as for series P wherein component C is replaced by the same amount of component B; Series S: 20% of component A, 10% of component B, 20% of component D; 0.5% of component H of Table I, 15% of ethanol, balance: water. 25 ml of the compositions P, R and S each were poured into 1000 ml of water heated at different temperatures (10°, 20°, 30° C.) from a height of about 15 cm and the solubility graded visually after 5 minutes, using a 0–5 scale (0 = completely insoluble, 5 = completely soluble).

TABLE III

| Water temperature | P | R | S |
|---|---|---|---|
| 10° C. | 5 | 3** | 0 |
| 20° C. | 5 | 4 | 2* |
| 30° C. | 5 | 5 | 3** |

*60% of product insoluble
**filaments of nonionics at the bottom

The criticality of the branching of the hydrophobic moiety of the nonionics of the general formula (I) in the instant compositions is illustrated in Table IV. Four series (T, U; V, W) of two compositions each were prepared, containing (in % by weight).

| Components | $T_1$ | $T_2$ | $U_1$ | $U_2$ | $V_1$ | $V_2$ | $W_1$ | $W_2$ |
|---|---|---|---|---|---|---|---|---|
| Triethanolamine salt of alkylbenzene sulfonic acid, having in average 11.9 carbon atoms in the alkyl group | 20 | 20 | 20 | 20 | 20 | 20 | 20 | 20 |
| Condensation product of about 4 moles of ethylene oxide with one mole of a primary alcohol | | | | | | | | |
| of about 25% branched-chain structure having 14 to 15 carbon atoms | 10 | — | 10 | — | 10 | — | 10 | — |
| of 50% branched-chain structure having 12 to 15 carbon atoms | — | 10 | — | 10 | — | 10 | — | 10 |
| Condensation product of 11 moles of ethylene oxide and one mole of a primary alcohol: | | | | | | | | |
| being tallow alcohol (mainly linear) | 20 | 20 | — | — | — | — | — | — |
| of mainly linear chain structure, having 16 to 19 carbon atoms | — | — | 20 | 20 | — | — | — | — |
| of about 35% branched-chain structure having 16 to 19 carbon atoms | — | — | — | — | 20 | 20 | — | — |
| of about 72% branched-chain structure having 16 to 19 carbon atoms | — | — | — | — | — | — | 20 | 20 |
| Ethanol | 10 | 10 | 10 | 10 | 10 | 10 | 10 | 10 |
| Triethanolamine (free) | 1 | 1 | 1 | 1 | 1 | 1 | 1 | 1 |
| Water | | | | | balance | | | |

The stability or chill-points of the compositions was measured, using the same procedure and equipment as in the test proceeding Table I. The results are:

TABLE IV

| | 1 | 2 |
|---|---|---|
| T | meso* | meso |
| U | meso | meso |
| V | 11° | 15° |
| W | <−7° | <−7° |

*meso = mesomorphic phase (gel) at 19–21°

The cleaning effectiveness of the liquid compositions of the present invention, if compared to a similar composition, is illustrated by the following test, whereby two series of different liquid detergent compositions were prepared, consisting of (in % by weight)

| components | 1 | 2 |
|---|---|---|
| Triethanolamine salt of linear alkylbenzene sulfonic acid wherein the alkyl chain averages 11.9 carbon atoms in length | 20 | 20 |
| Condensation product of one mole of a primary alcohol of up to 5% branched-chain structure, having 14 to 15 carbon atoms and about 4 moles of ethylene oxide | 10 | 10 |
| Condensation product of one mole of tallow alcohol and about 11 moles of ethylene oxide | 20 | — |
| Condensation product of one mole of a primary alcohol of about 72% branched-chain structure having 16 to 19 carbon atoms and about 11 moles of ethylene oxide | — | 20 |
| Ethanol | 15 | 10 |
| Fatty acid derived from hydrogenated fish oil (average molecular weight 285) | 0.5 | 0.5 |
| Optical brightener (stilbene type) | 0.2 | 0.2 |
| Perfumes, dyes | 0.8 | 0.8 |
| Silicone-based suds regulating agent* | 0.1 | 0.1 |

-continued

| components | 1 | 2 |
|---|---|---|
| Water | balance | |

*Emulsion of 3 parts of a mixture of dimethylpoly-siloxane and aerogel silica, (weight ratio siloxane : silica = 9:1) and 7 parts of a highly ethoxylated fatty acid (sold by Dow Corning Corporation as DB 31).

With each of these compositions, four loads of about 3kg each of domestic soiled laundry were washed in a horizontal drum-type automatic washing machine (MIELE 416 S). Each load contained in addition two cotton and two polyester swatches (20 × 20 cm), soiled with greasy stains, lip-stick, make-up and dirty motor oil respectively. These loads of domestic soiled laundry and swatches were washed in the main wash cycle of the washing machine in about 20 liters of water (hardness: 3.14 millimoles/liter as $CaCO_3$), containing 120 gr (0.6% by concentration) of the liquid detergent composition tested. The temperature of the washing liquor was raised to about 60° C. over a period of about 35 minutes. After dilution of the washing liquor, evacuation of the latter, and rinsing (five cycles with about 10 liters; hardness: 3.14 millimoles/liter; temperature 19°–16° C. and spinning) the swatches were line-dried, visually graded, using a 0–5 scale (0: no removal of stain; 5: complete removal) and the results of all stains and all swatches pooled.

The washing tests described above were repeated once more, whereby all conditions were the same, except that each of the swatches were pretreated with 2 gr of the compositions tested (i.e. 32 gr in total per load) and only about 88 gr of the detergent composition was added into the washing liquor (resulting in a total concentration of about 0.60% by wt).

The results on stain removal performance are:

| washing cycle | (1) | | (2) |
|---|---|---|---|
| Main wash only | 3.0 | * | 3.25 |
| Topical application followed by main wash | 4.0 | * | 4.25 |

* significant difference betwen the 2 treatments at 95% confidence, by variance analysis.

Thus the compositions of the present invention show a significant visual difference in cleaning performance over similarly formulated liquid detergent compositions.

In resume, it follows from the Tables that the instant compositions have better stability on storage at low temperatures, better dissolving properties in cold and tepid water yielding both processing advantages and dispersibility in washing solutions, than similar compositions containing straight-chain or slightly branched-chain nonionics having the same number of carbon atoms and degree of ethoxylation and higher amounts of liquid, organic carrier.

Optional Components

An optional component of the instant compositions is an alkanolamine compound. The free alkanolamine useful herein is selected from the group consisting of monoethanolamine, diethanolamine, triethanolamine, and mixtures thereof. The excess alkanolamine beyond that necessary to form any anionic surfactant salt serves as a buffering agent, which maintains the washing liquid pH of the instant compositions within the preferred range of from about 6.5 to about 8.5. A pH of about 7 to about 8 is most preferred. Concentrations of free alkanolamine preferably present in the instant compositions can be up to 3%, preferably up to 1% by weight of the total composition.

Another optional but preferred component is a silicone-based suds controlling and regulating agent. A heavy duty liquid detergent composition designed for use in both horizontal and vertical washing machines must have acceptable sudsing properties when used in either of these machines. The silicone-based suds controlling and regulating agents useful herein can be alkylated, optionally partially ethoxylated, polysiloxane materials of several types, in combination with solid materials such as solid silica, silica aerogels, xerogels and hydrophobic silicas of various types. Suitable examples of alkylated polysiloxanes are dimethylpolysiloxanes having a molecular weight of from about 200 to 200,000. Suitable examples of mixtures of alkylated siloxanes and solid silica have a siloxane/silica ratio of from 20:1 to 3:1, preferably 10:1 to 4:1. Concentrations of suds controlling agents useful in the instant compositions normally vary, depending upon the choice of the regulating agent, between 0.005% and 5%. The silicon/silica suds regulating agent is preferably used at a level in the range from 0.05% to 0.5%, or 0.01% to 0.5%.

A preferred suds controlling agent herein comprises a mixture of (a) dimethylpolysiloxane and silica-aerogel in a 9:1 weight ratio emulsified in (b) a nonionic of the general formula $R'COO—(C_2H_4O)_P—H$, wherein R' is an aliphatic hydro-carbon chain having 10 to 22 carbon atoms and p is a number of at least 3, in a weight ratio of (a) to (b) of from about 1:4 to 1:1, preferably about 1:2. Due to the pre-emulsification of the siloxane and silica, the preferred suds controlling agent is easily dispersed in the instant compositions, and shows an extraordinary storage stability and suds controlling effectiveness irrespective of the aging. Concentrations of the preferred silicone-based suds controlling agents, preferably present in the instant compositions can be up to 0.5% by weight, preferably between 0.01% and 0.2% by weight.

Another optional additive is an enzyme. Enzymes are frequently desirable in heavy duty detergent compositions. Commercially-available enzymes are generally either dry-powdered products, containing 2 to 80% active enzymes in combination with an inert powdered vehicle such as sodium and calcium sulfate, sodium chloride, clay or starch and mixtures thereof as the remaining 98–20%, or are pasty product, containing 5 to 75% active enzymes, and electrolytes as sodium and calcium sulfates, and liquid ethoxylated nonionics as the remaining 95–25%. The active enzyme content of a commercial product is a result of manufacturing methods employed and is not critical herein. Due to the outstanding physical properties of the compositions of the present invention, amounts up to 5%, preferably up to 2.5% by weight, calculated on the weight of essential surfactants, of said commercial enzyme products, including those having up to 90% of inert vehicle, can be incorporated therein without negatively affecting the stability and homogeneity. Pasty or liquid enzyme products are preferably presolubilized and the precipitating electrolytes removed, e.g. by filtration. Preferred are proteolytic enzymes, especially those derived from Bacillus species.

Other optional components include brighteners, fluorescers, antimicrobial agents and coloring agents. Such components preferably comprise no more than about 3% by weight of the total compositions. One particular advantage of the instant compositions is that the hardly water-soluble brighteners and fluorescers can be added either directly to the compositions, i.e., as such, or during any step of the formulation process. Specific examples of preferred brighteners useful herein are the stilbene type brightener of the general formula:

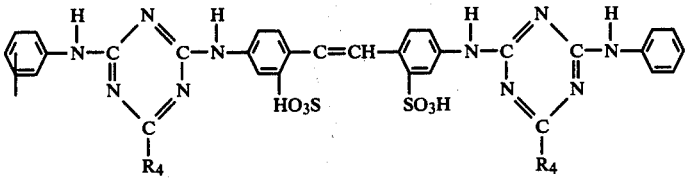

or the salts thereof, wherein $R_4$ is selected from the group consisting of $—N(CH_2CH_2OH)_2$, $—NHC_6H_5—$, morpholino,

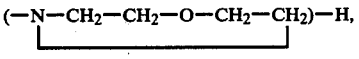

$NH_2$, and $—N(CH_3)C_2H_5OH$; and disteryl-diphenyl type brighteners.

The following examples additionally illustrate the liquid detergent compositions of the present invention. The figures are percentages by weight. The abbreviations for the nonionic surfactants employed, e.g., $C_{12-15}(EO)_4$ are standard for such materials and describe the carbon content of the hydrophobic moiety of the molecule and the ethylene oxide content of the hydrophilic moiety of the molecule.

EXAMPLE I

A storage-stable, homogeneous, non-gelling, heavy duty liquid detergent is formulated having the following composition:

| | |
|---|---|
| Triethanolamine salt of a linear alkylbenzene sulfonic acid, wherein the alkyl chain averages 11.7 carbon atoms in length | 20 |
| $C_{16-19}(EO)_{11}$ of 72% branched-chain structure | 20 |
| $C_{12-15}(EO)_4$ of about 60% branched-chain structure | 10 |
| Isopropanol | 10 |
| Optical brightener (Stilbene type) | 0.25 |
| Fatty acid having in average 18–22 carbon atoms | 0.75 |
| Triethanolamine (free) | 1.0 |
| An emulsion of 3 parts of a mixture of dimethylpolysiloxane and aerogel silica (weight ratios 9:1) and 7 parts of an ethoxylates fatty acid | 0.1 |
| Water | Balance |

The foregoing composition, which is stable even at temperatures of −7° C., provides excellent fabric cleaning when used either full strength as a pre-treatment or for through-the-wash detergency at a level of 5,000 ppm, and does not oversuds in a horizontal automatic washing machine.

EXAMPLE II

Heavy duty, highly concentrated liquid detergents are formulated having the following composition (figures are percentages by weight):

| | A | B |
|---|---|---|
| Na-salt of a linear alkylbenzene sulfonic acid wherein the alkyl chain averages 12 carbon atoms in length | 5 | — |
| Triethanolamine salt of a linear alkylbenzene sulfonic acid wherein the alkyl chain averages 12 carbon atoms in length | 20 | 25 |
| $C_{16-19}(EO)_{9-11}$ of about 72% branched-chain structure | 30 | 30 |
| $C_{12-15}(EO)_4$ of about 60% branched-chain structure | 15 | 17 |
| Ethanol* | 12 | 9 |
| Optical brightener (Stilbene type) | 0.2 | 0.2 |
| Fatty acid derived from hydrogenated fish oil | 1 | 0.7 |
| Triethanolamine (free) | 2.5 | 1.5 |
| Suds controlling agent** | 0.1 | 0.08 |
| Perfume, dyes | 0.5 | 0.5 |
| Water | Balance | |

*In both A and B, the ethanol can be replaced entirely by isopropanol,butanol or by 1:1 mixtures of ethanol and sodium cumene sulfonate.

**As in Example I. The two foregoing compositions are stable over a wide temperature range and both provide roughly equivalent and excellent soil and grease stain removal when applied topically as such followed by conventional washing at 6,000 ppm concentrations, and at temperatures of about 35° C.

The two foregoing compositions are stable over a wide temperature range and both provide roughly equivalent and excellent soil and grease stain removal when applied topically as such followed by conventional washing at 6,000 ppm concentrations, and at temperatures of about 35° C.

EXAMPLE III

| | C | D | E | F | G | H | I | J | K |
|---|---|---|---|---|---|---|---|---|---|
| Triethanolamine salt of a linear alkylbenzene sulfonic acid, wherein the chain averages 12 carbon atoms in length | 20 | 20 | 20 | 12.5 | 12.5 | 10 | 12.5 | 10 | 10 |
| Tallow-$(EO)_{11}$ | 20 | — | — | 12.5 | — | 20 | — | 30 | — |
| $C_{16-19}(EO)_{11}$ of 75% branched-chain structure | — | 20 | 20 | — | 12.5 | — | 25 | — | 30 |
| $C_{14-15}(EO)_4$ of mainly linear chain structure | 10 | 10 | — | 7 | 7 | — | — | — | — |
| $C_{12-15}(EO)_4$ of 58% branched chain structure | — | — | 10 | — | — | 20 | 25 | 10 | 10 |
| Ethanol/isopropanol in a 1:1 weight ratio | | | | | 10 | | | | |
| Optical brightener (Stilbene type) | | | | | 0.2 | | | | |
| Proteolytic enzyme* | | | | | 1.5 | | | | |
| Suds controlling agent** | | | | | 0.1 | | | | |
| Triethanolamine (free) | 2 | 2 | 2 | 1.3 | 1.3 | 1.4 | 1.4 | 1.7 | 1.7 |
| Perfumes, dyes | | | | | 0.5 | | | | |
| Water | | | | | balance | | | | |

*proteolytic enzyme: "ALCALASE" a proteolytic enzyme product, made by NOVO Industri A/S, Copenhagen, Denmark; containing 6% by weight of active enzyme.

**suds controlling agent: as in Example I.

Compositions C, F, H and J are highly viscous to solid, while compositions E, E, G, I and K are stable and homogeneous at room temperatures.

EXAMPLES IV–XIII

Another series of examples illustrating the present invention are:

| | IV | V | VI | VII | VIII | IX | X | XI | XII | XIII |
|---|---|---|---|---|---|---|---|---|---|---|
| Monoethanolamine salt of a linear alkylbenzene sulfonic acid wherein the alkyl chain averages 11.9 carbon atoms in length | — | — | — | — | — | — | — | 16.2 | — | — |
| Triethanolamine salt of a linear alkylbenzene sulfonic acid wherein the alkyl chain averages 11.9 carbon atoms in length | — | | 10.0 | 20 | 25 | 15 | 15 | — | 15 | 5 |
| Sodium salt of a linear alkylberzene sulfonic acid wherein the alkyl chain averages 11.9 carbon atoms in chain length | — | 15 | 7.5 | — | — | — | — | — | — | — |
| Triethanolamine salts of secondary paraffin sulfonic acid having in average 14.5 carbon atoms | 22 | | | | | | | | | |
| $C_{14-15}$ $(EO)_4$ of mainly linear chain structure | — | — | 10 | — | 5 | — | 5 | 10 | — | 5 |
| $C_{12-15}$ $(EO)_4$ of about 60% branched chain structure | 10 | 10 | — | 10 | — | 15 | — | — | 30 | — |
| $C_{16-19}$ $(EO)_{11}$ of about 72% branched chain structure | 20 | 20 | 20 | 20 | 20 | 20 | 30 | 20 | 30 | 15 |
| Sodium toluene sulfonate | — | — | — | — | 4 | — | — | — | — | — |
| Fatty acid derived from hydrogenated fish oil | — | — | — | 0.5 | —1.5 | 1.5 | — | 1.0 | 1.0 | |
| Suds regulating agen* | 0.2 | 0.2 | 0.2 | 0.1 | 0.2 | — | — | 0.1 | 0.1 | — |
| Enzyme** | — | 1 | — | 1 | — | — | 1 | 1 | — | 1 |
| Brightener (stilbenze type) | 0.3 | 0.2 | 0.2 | 0.3 | 0.3 | 0.3 | 0.3 | 0.2 | 0.2 | 0.2 |
| Ethanol | 10 | 10 | 10 | 7.5 | 5 | 9 | 10 | 8.5 | 10 | 10 |
| Perfume, dyes | 1 | 1 | 1.5 | 0.8 | 1 | 1.5 | 0.5 | 1 | 1 | 1 |

-continued

| | IV | V | VI | VII | VIII | IX | X | XI | XII | XIII |
|---|---|---|---|---|---|---|---|---|---|---|
| Water | | | | | balance | | | | | |

*suds controlling agent of Examples IV, V, VII and X - XIII is the one as specified in Example I, and of Example VIII is a commercial mixture of alkoxylated polymethyl siloxane, polydimethyl siloxane liquid, polysiloxane resin and aerogel silica (sold by Dow Corning Corporation as DC-544).

**Enzyme of Examples V, X and XI is "MAXATASE", a proteolytic enzyme product, made by KNGS. N.V. Delft, The Netherlands, containing about 5% by wt of active enzyme and XIII is "ESPERASE", a proteolytic enzyme product, made by NOVO Industric A/S, Copenhagen, Denmark, containing about 5% by wt of active enzyme.

EXAMPLES XIV–XX

Storage-stable, non-gelling, homogeneous, heavy duty liquid detergent compositions are:

| | XIV | XV | XVI | XVII | XVIII | XIX | XX |
|---|---|---|---|---|---|---|---|
| Triethanolamine salt of linear alkylbenzene sulfonic acid, wherein the alkyl chain averages 11.4 to 11.9 carbon atoms in chain length | 10 | 5 | 10 | 15 | 20 | 50 | 15 |
| $C_{12-15}$ $(EO)_4$ of 58% branched-chain structure | 10 | 7.5 | 5 | 22.5 | 10 | 15 | 37.5 |
| $C_{16-19}$ $(EO)_{11}$ of 72% branched-chain structure | 30 | 12.5 | 10 | 37.5 | 20 | 30 | 22.5 |
| Ethanol | 5 | 6 | 7 | 8 | 10 | 10 | 10 |
| Optical brightener (stilbene type) | 0.4 | 0.3 | 0.3 | 0.5 | 0.5 | 0.5 | 0.5 |
| Triethanolamine (free) | 1.5 | 0.8 | 1.0 | 1.5 | 1.5 | 1.5 | 1.0 |
| Suds controlling agent* | 0.2 | 0.1 | 0.05 | 0.05 | 0.1 | 0.2 | 0.2 |
| Fatty acid derived from fish oil | 1.0 | 1.0 | 1.0 | 1.5 | 1.5 | 1.0 | 1.0 |
| Water | | | | balance | | | |

*mixed silicone fluid/silicone resin/silica materials, prepared in the manner disclosed in U.S. Pat. No. 3,455,839.

What is claimed is:

1. A liquid, stable, concentrated, essentially homogeneous heavy duty detergent composition consisting essentially of:

(1) from about 35% to about 65% by weight of a mixture of:

(A) a nonionic surfactant having the formula $$R_1O-(C_2H_4O)_x-H$$

wherein $R_1$ represents a hydrocarbyl group derived from a primary hydrocarbon monohydric alcohol of at least 70% branched-chain structure having from about 16 to about 19 carbon atoms, and x is a number of from about 9 to about 13;

(B) a nonionic surfactant having the formula $$R_2O-(C_2H_4O)_y-H$$

wherein $R_2$ is a hydrocarbyl group derived from a primary or secondary, straight or branched aliphatic alcohol of at least 40% branched-chain structure having from about 12 to about 15 carbon atoms, and y is a number from about 3 to about 6;

wherein the weight ratio of (A) to (B) is from about 5:1 to about 2:1;

(C) a triethanolamine salt of an alkylbenzene sulfonic acid having on average about 12 carbon atoms in the alkyl group;

wherein the weight ratio of (A) + (B) to (C) is from about 4:1 to about 2:1;

(2) from about 3% to about 15% by weight of a liquid organic carrier selected from the group consisting of: ethanol; n-propanol; iso-propanol; alkali-metal salts and ethanolamine salts of cumene sulfonic acid; and mixtures thereof;

(3) a silicone suds-controlling agent in an amount from 0.01% to 0.2% by weight; and (4) water.

* * * * *